US005899046A

United States Patent [19]

Hughes

[11] Patent Number: 5,899,046

[45] Date of Patent: May 4, 1999

[54] EDGE PROTECTOR FOR MASONRY PRODUCTS AND A SYSTEM FOR ITS APPLICATION

[76] Inventor: Barry T. Hughes, 1104 Robs Rd., Jacksonville, Tex. 75766

[21] Appl. No.: 08/932,250

[22] Filed: Sep. 17, 1997

[51] Int. Cl.[6] ..... B65B 61/00

[52] U.S. Cl. ..... 53/139.7; 53/589; 206/586

[58] Field of Search ..... 206/586, 453; 53/131.5, 139.6, 139.7, 582, 589, 591

[56] References Cited

U.S. PATENT DOCUMENTS

| | | | |
|---|---|---|---|
| 2,815,626 | 12/1957 | Fahrenbach | 53/131.5 X |
| 2,844,091 | 7/1958 | Shafer et al. | 53/589 X |
| 2,869,721 | 1/1959 | Baumer | 206/65 |
| 3,049,260 | 8/1962 | Stone | 206/586 X |
| 3,329,262 | 7/1967 | Martin et al. | 206/65 |
| 3,531,040 | 9/1970 | Myny | 206/586 X |
| 3,661,252 | 5/1972 | Weichberger | 206/586 X |
| 3,836,043 | 9/1974 | Levin | 206/586 X |
| 4,202,449 | 5/1980 | Bendt | 206/453 |
| 4,244,471 | 1/1981 | Plante | 53/139.7 X |
| 4,665,679 | 5/1987 | Watanabe | 53/131.5 |
| 4,865,201 | 9/1989 | Liebel | 206/586 |
| 4,874,095 | 10/1989 | Warych | 206/586 |

*Primary Examiner*—Linda Johnson
*Attorney, Agent, or Firm*—Baker & Botts, L.L.P.

[57] ABSTRACT

An edge protector (10) for a brick package (20) is provided. The edge protector (10) comprises a length of pliable material (11) having a fixed width (13) and corrugated profile (15). The edge protector (10) is installed on the edges of the brick package (20) such that a general "L" shape is formed, thus protecting bricks (22) during shipping.

18 Claims, 3 Drawing Sheets

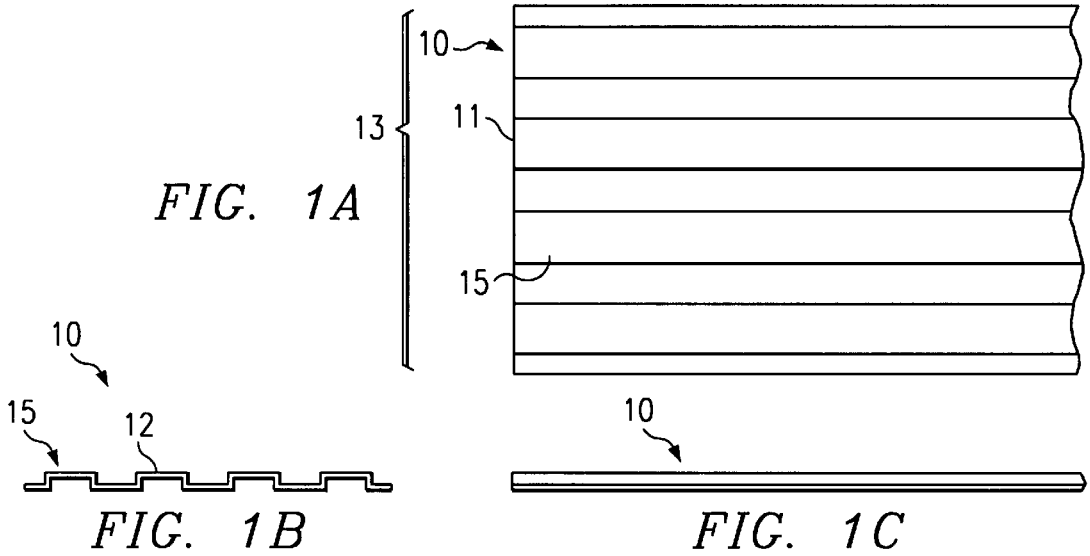
FIG. 1A
FIG. 1B
FIG. 1C
FIG. 2
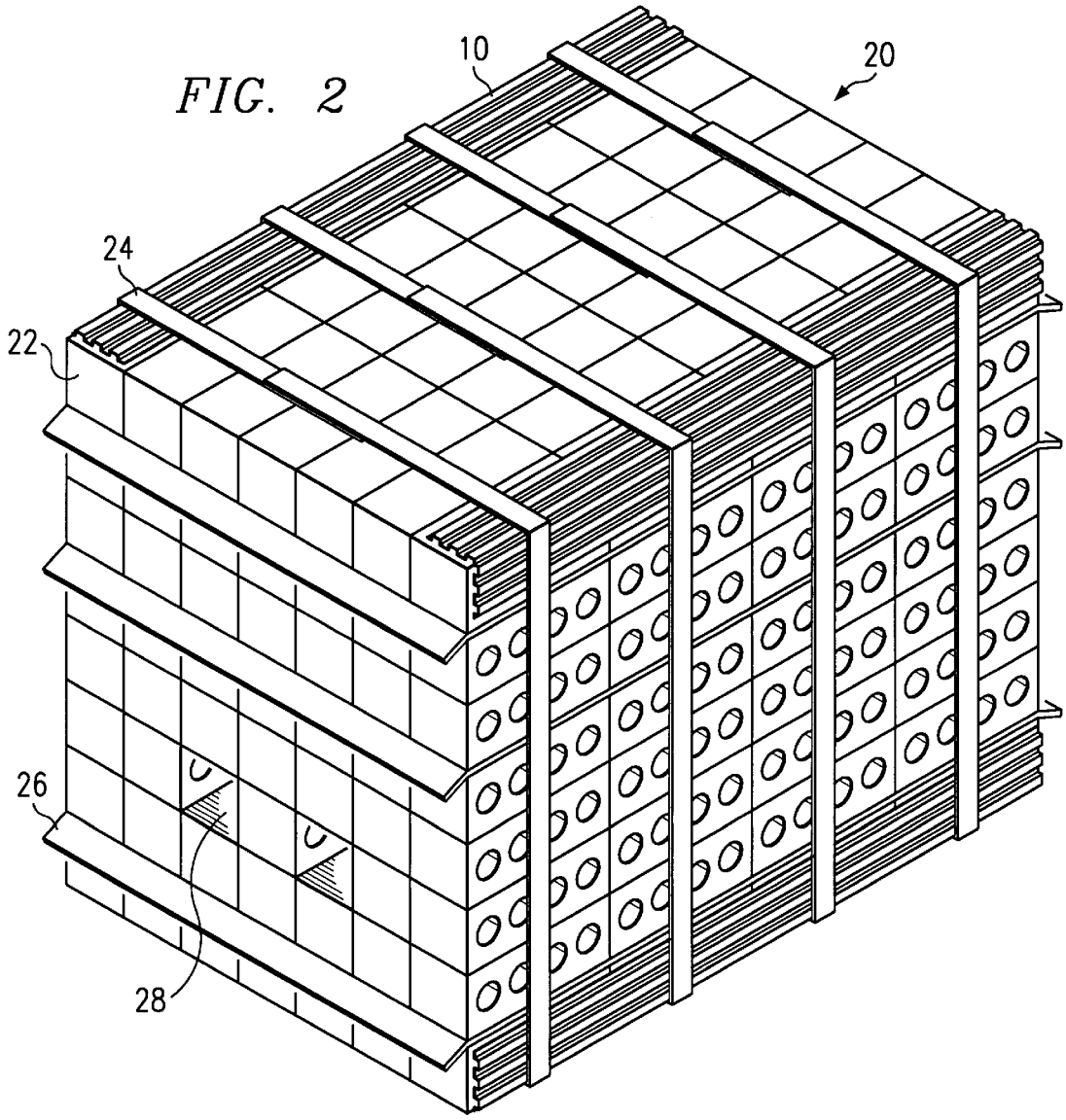

EDGE PROTECTOR FOR MASONRY PRODUCTS AND A SYSTEM FOR ITS APPLICATION

TECHNICAL FIELD OF THE INVENTION

The present invention relates to brick packages and more particularly to an edge protector for a masonry product such as brick or cinder block and a system for its application.

BACKGROUND OF THE INVENTION

Masonry products such as bricks (as well as pavers, cement or glass blocks and other similar building materials) are typically shipped in large cubes consisting of stacks of bricks. These cubes are placed on pallets or have openings in the cubes to accept a forklift. The different layers of brick are separated by paper and the bricks are secured by steel or plastic straps encircling the brick packages. In order to protect the edges of the bricks and hold the packaging together, a longitudinally disposed edge protector is often provided. This edge protector is perpendicular to the strap and is placed along four edges of the cube and under the straps. The edge protectors take on an "L" shape when placed on the bricks and serve to both protect the edges of the bricks and hold the packages together. One such edge protector is illustrated in U.S. Pat. No. 3,329,262, entitled "Elastic Protective Corner and Tensioning Strips for Transportable Brick Packages" and issued to Martin et al. on Jul. 4, 1967.

While this is a popular way of transporting bricks, the edge protectors can slip when the straps used to secure the cubes are applied. This is especially true when modern plastic straps are used. This results in exposed edges, damage to the bricks or blocks and loss of packaging integrity.

Additionally, current edge protectors are made flat and are bent to the required "L" shape using a special form die when applied to the packaging. Due to the smooth texture of the surface of the strip, a correct "L" shape is not always formed, resulting in unsatisfactory packaging.

Also, edges of bricks are often very sharp. Current flat edge protectors fail to offer sufficient cushioning against this sharp edge and will tear or otherwise become non-functional.

SUMMARY OF THE INVENTION

From the foregoing, it may be appreciated that a need has arisen for an improved edge protector for brick packaging. In accordance with the present invention, an edge protector for brick packaging is provided which substantially eliminates or reduces disadvantages and problems associated with current brick edge protectors.

In one embodiment an edge protector for brick packaging is provided. The edge protector comprises a length of pliable material of a fixed width. The edge protector has a corrugated profile.

The present invention provides various technical advantages over current edge protectors. For example, one technical advantages is that the edge protector does not shift under the stress of plastic or steel strapping. Another technical advantage is that the corrugated profile provides cushioning against the sharp edges of bricks. Another technical advantage is that the edge protector for the present invention will not split or crack when formed into an "L" shape and placed under straps encircling the brick package. Other technical advantages may be readily apparent to one skilled in the art from the following figures, descriptions and claims.

BRIEF DESCRIPTION OF THE DRAWINGS

For a more complete understanding of the present invention and for further features and advantages, reference is now made to the following description taken in conjunction with the accompanying drawings, in which:

FIG. 1A is a fragmentary perspective view of an edge protector in accordance with the present invention;

FIG. 1B is a view of a corrugated profile of an edge protector in accordance with the present invention;

FIG. 1C is a side view of an edge protector in accordance with the present invention;

FIG. 2 illustrates a brick cube with edge protectors in accordance with the present invention;

DETAILED DESCRIPTION OF THE INVENTION

Figure 3:
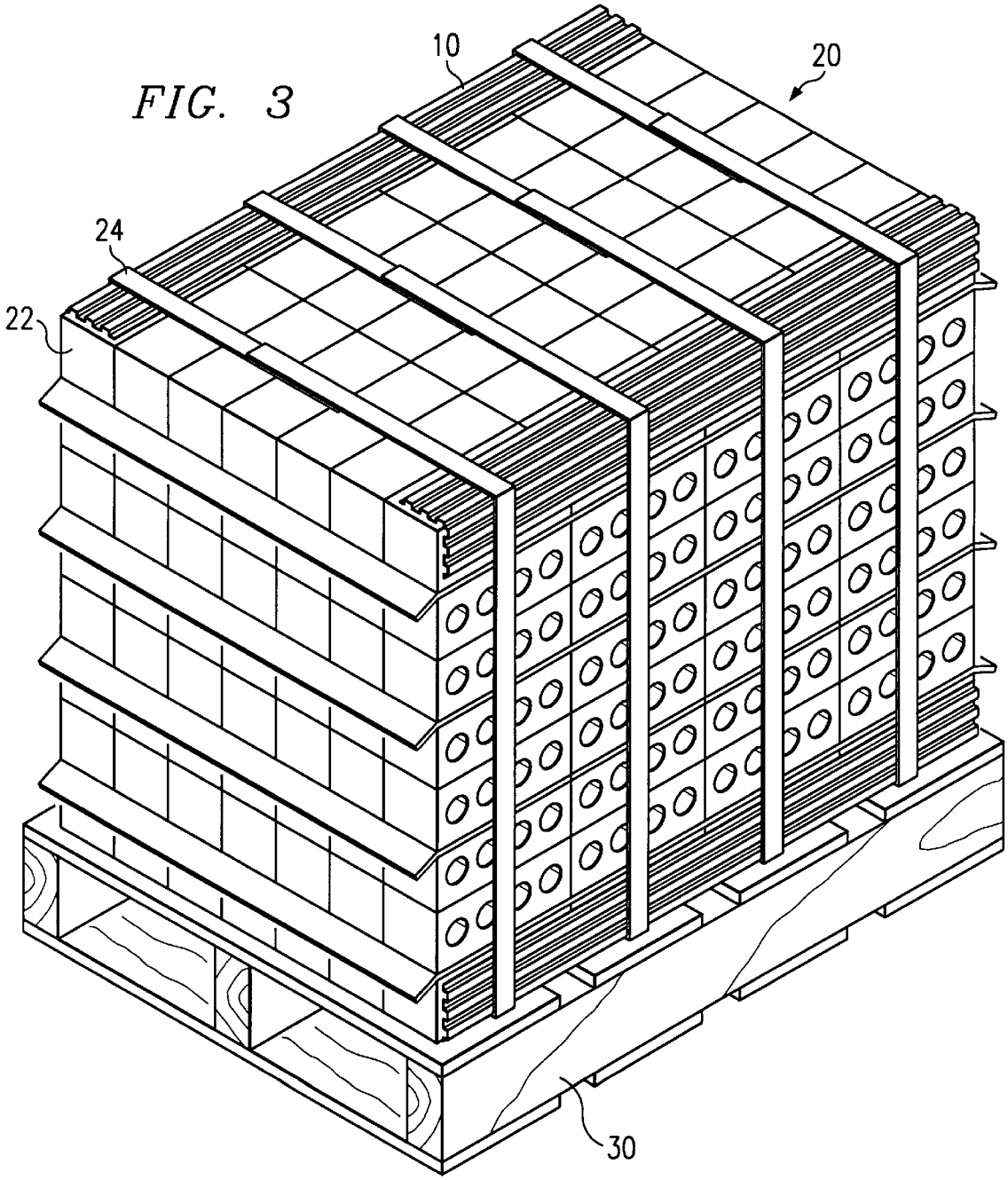
FIG. 3 illustrates another type of brick cube with edge protectors in accordance with the present invention.

The preferred embodiment of the present invention and its advantages are best understood by referring to FIGS. 1–4 of the drawings, where like numerals are used for like and corresponding parts of the various drawings.

FIG. 1A is a fragmentary perspective view of an edge protector 10. In one embodiment, the edge protector 10 is formed of a pliable material 11 having a fixed width 13. Edge protector 10 can be approximately two to three inches wide, although other widths are acceptable as long as edge protector 10 is able to cover the edges of the bricks or other building materials in a cube. Edge protector 10 also has a corrugated profile 15.

Typically edge protector 10 is provided in a large roll. In one embodiment, edge protector 10 is manufactured by combining a base polypropylene resin with an EPDM rubber. The rubber allows edge protector 10 to flex and bend and allows edge protector 10 to be bent into the desired "L" shape. It has been found that between 10–12% rubber provides sufficient flexing while maintaining sufficient material strength.

The polypropylene used is typically a homopolymer. Other additives can be added during manufacturing to meet different needs. For example, color concentrate may be added for coloring, ultraviolet inhibitors and stabilizers can be added to prolong outdoor storage and flame retardants can be added for general fire protection and to prevent the edge protector from burning when cut with a heated knife. These materials are blended and the extruded to form a single sheet or strand. In one embodiment, the materials are oriented to enhance tensile strength and other mechanical properties.

FIG. 1B is a profile view of a corrugated profile 15 of edge protector 10. Corrugated profile 15 in this embodiment is comprised of a plurality of ridges 12. Ridges 12 help to improve the formability of edge protector 10 by allowing it to take on the required L shape to fit over the edges of the bricks without the use of a form. Ridges 12 also allow edge protector 10 to be fed over the bricks by automated machinery.

Ridges 12 also allow edge protector 10 to fit and adhere to the bricks better than edge protectors without such a profile. This is because the ridges provide a reduced area of contact with the steel or plastic strapping which is applied over the bricks so less slipping occurs when the straps are tensioned. This is especially important where plastic strapping is used since that type of strapping causes edge protectors to slip more than steel strapping. Additionally, ridges 12 provide a cushion around the sharp edges of the bricks or blocks, thus increasing the durability of the cube.

While ridges are shown in FIG. 1B, other corrugated profiles can also be employed such as sinusoidal profiles, sawtooth profiles, a dimpled profile or any other corrugated profile that can obtain similar advantages can be used.

FIG. 1C is a side view of edge protector 10. Typically, edge protector 10 is between 0.020 and 0.60 inches thick depending on the ridged pattern employed.

FIG. 2 illustrates a brick cube 20 with edge protectors 10. Brick cube 20 is formed by bricks 22. Brick cube 20 is also known as a brick packaging. Layers of bricks 22 are separated by paper 26. In this brick cube 20, openings 28 are provided. This allows a forklift or similar device to easily move the cube. Edge protectors 10 are placed on four sides of brick cube 20 and are disposed in an "L" shape. Straps 24 are placed across edge protector 10 to hold brick cube 20 together. Straps 24 are traditionally steel straps but plastic strapping is beginning to replace steel strapping. A single horizontal portion of brick cube 20 is known as a course. Straps 24 are placed around a course. As can be seen, edge protector 10 also serves to hold several courses together. While brick cube 20 or brick packaging is illustrated as being a plurality of bricks, the term and concept encompasses any other masonry product such as pavers and cement or glass blocks.

FIG. 3 illustrates another type of brick cube 20. In this case, brick cube 20 is placed on a pallet 30 instead of having openings in the cube itself. Forklifts or similar devices would engage pallet 30 to move brick cube 20. In an alternative embodiment, strap 24 encompasses both brick cube 20 and pallet 30 to form a single unit.

Figure 4:
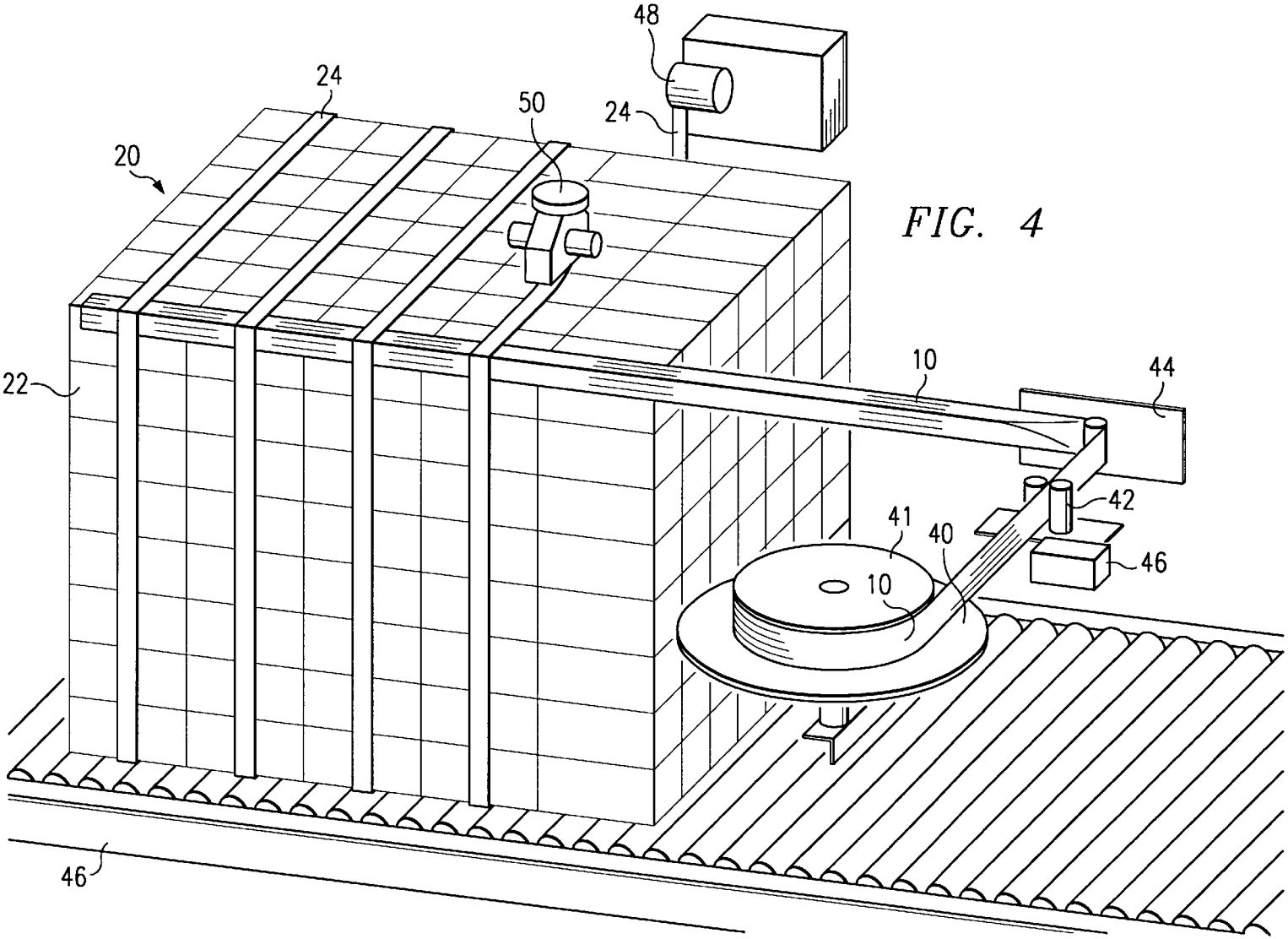
FIG. 4 illustrates a preferred manner for applying an edge protector during the assembly of a brick cube in accordance with the present invention.

FIG. 4 illustrates a preferred manner for applying edge protector 10 during the assembly of brick cube 20. Illustrated is a carousel 40 that holds a roll of edge protector 10. A set of tensioners 42 and an edge guide 44 help to position edge protector 10. Brick cube 20 is supported on a conveyor system 46. Straps 24 are illustrated surrounding brick cube 20.

In operation, a fully stacked brick cube 20 is provided. Starting at the end of brick cube 20, edge protector 10 is provided to cover the edge of brick cube 20. Edge protector 10 is provided in a large roll mounted on carousel 40. Typically these rolls contain several thousand feet of edge protector 10. The corrugated profile of edge protector 10 keeps edge protector 10 from telescoping out from the center of the roll and facilitates the handling of the rolls. Carousel 40 rotates as more edge protector 10 is needed. As edge protector 10 is provided, it passes through tensioners 42 which ensures sufficient tension on edge protector 10 in order to establish a tight fit to the edge. Alternatively, in place of tensioners 42, a steel cover can be placed on top of carousel 40, covering edge protector 10. With the cover locking the roll onto carousel 40 tension can be applied by a simple friction break on carousel 40. Either method would provide sufficient tension.

Edge protector 10 then passes through tensioners 42 to guide 44. Guide 44 ensures that edge protector 10 is in the proper orientation to be applied to brick cube 20. Depending on the location and orientation of carousel 40, multiple guides 44 may be utilized. From guide 44, edge protector 10 feeds onto brick cube 20 in the proper "L" shape to cover the edges of bricks 22. As edge protector 10 is applied and brick cube 20 moves down conveyor 46, straps 24 are provided. Straps 24 are fed from strap holder 48 and are secured and tightened using a strapping machine 50. While only one carousel is pictured, a similar arrangement is used on the other three sides to complete brick cube 20. After a complete brick cube 20 is finished a hot knife or other cutting instrument cuts edge protector 10 to form a complete package. Another brick cube 20 can be provided so that the process can start over again. Optionally, a printer 46 can be installed after the carousel for printing information such as lot numbers, warning labels, company names and logos or other messages on edge protector 10 prior to installing on brick cube 20. Alternatively, edge protector 10 may be pre-printed.

Thus, it is apparent that there has been provided, in accordance with the present invention, an edge protector for brick packaging together with a method for its application that satisfies the advantages set forth above. Although the preferred embodiment has been described in detail, it should be understood that various changes, substitutions, and alterations may be apparent to those skilled in the art and may be made herein without departing from the spirit and scope of the present invention as defined by the appended claims.

What is claimed is:

1. An edge protector for a brick package comprising a length of machine loadable, pliable plastic material having a fixed width, a corrugated profile and operable to be bent along any one of multiple lines perpendicular to the width, and secured over the edge of the brick package in essentially an "L" shaped.

2. The edge protector of claim 1, wherein the plastic is comprised of polypropylene.

3. The edge protector of claim 1, wherein the pliable material is a composition of polypropylene and rubber.

4. The edge protector of claim 3, wherein the composition comprises 10–12% rubber.

5. The edge protector of claim 1, wherein the corrugated profile is a ridged profile.

6. The edge protector of claim 1, wherein the corrugated profile is a wave profile.

7. The edge protector of claim 1, wherein the corrugated profile is a sawtooth profile.

8. A system for applying an edge protector on a brick package comprising:

a length of edge protector, the edge protector comprising a flat length of pliable plastic having a fixed width and a corrugated profile;

a carousel operable to store and supply the edge protector;

a conveyor system coupled to the carousel and operable to transport the brick package, the brick package operable to receive the edge protector at one end of the brick package, the edge protector covering the edge of the brick package with a continuous L shape without preforming the edge protector as the brick package moves along the conveyor system; and a strapping machine associated with the conveyor system and operable to apply a cross strap around the brick package, perpendicular to and on top of the edge protector.

9. The system of claim 8, further comprising a plurality of edge guides, the edge guides operable to receive the edge protector from the carousel and to change the orientation of the edge protector.

10. The system of claim 8 further comprising a tensioner operable to provide tension on the edge protector as it feeds on to a brick package.

11. The system of claim 10, wherein the tensioner is a cover with a friction device placed on the carousel.

12. The system of claim 8, wherein the plastic is comprised of polypropylene.

13. The system of claim 8, wherein the plastic is a composition of polypropylene and rubber.

14. The system of claim 13, wherein the composition comprises 10–12% rubber.

15. The system of claim 8, wherein the corrugated profile is a ridged profile.

16. The system of claim 8, wherein the corrugated profile is a wave profile.

17. The system of claim 8, wherein the corrugated profile is a sawtooth profile.

18. The system of claim 8, further comprising a printer provided after the carrousel and operable to print messages on the edge protector.

* * * * *